United States Patent [19]

Wüsthof et al.

[11] 4,264,288

[45] Apr. 28, 1981

[54] GEROTOR MACHINE WITH FLOW CONTROL RECESSES IN THE INNER GEAR MEMBER

[75] Inventors: Peter Wüsthof, Lohr; Johann Schneider, Lohr-Wombach, both of Fed. Rep. of Germany

[73] Assignee: G. L. Rexroth GmbH, Lohr, Fed. Rep. of Germany

[21] Appl. No.: 53,715

[22] Filed: Jul. 2, 1979

[30] Foreign Application Priority Data

Jul. 5, 1978 [DE] Fed. Rep. of Germany ..... 2829417

[51] Int. Cl.[3] ..... F01C 1/113; F01C 19/08; F01C 21/12

[52] U.S. Cl. ..... 418/61 B; 418/133; 418/186

[58] Field of Search ..... 418/61 B, 131, 132, 418/186, 133

[56] References Cited

U.S. PATENT DOCUMENTS

| | | | |
|---|---|---|---|
| 2,989,951 | 6/1961 | Charlson | 418/61 B |
| 3,270,683 | 9/1966 | McDermott | 418/61 B |
| 3,431,863 | 3/1969 | Waldorff | 418/61 B |
| 3,490,383 | 1/1970 | Parrett | 418/61 B |
| 3,825,376 | 7/1974 | Petersen et al. | 418/61 B |
| 3,841,801 | 10/1974 | Sturlason et al. | 418/61 B |
| 3,905,727 | 9/1975 | Kilmer | 418/61 B |
| 4,025,243 | 5/1977 | Stephens | 418/61 B |

*Primary Examiner*—John J. Vrablik
*Attorney, Agent, or Firm*—Michael J. Striker

[57] ABSTRACT

A gerotor machine has a housing and a displacement unit in the housing. The displacement unit includes an inner gear wheel rotatable about an axis, and an outer gear wheel which has an axis circularly displaceable about the axis of rotation of the inner gear wheel. The gear wheels bound a plurality of displacement chambers therebetween. A plurality of recesses are formed between the teeth of one of the gear wheels, and each of the recesses has two circumferentially spaced control edges at one axial end of the one gear. The housing is provided with a plurality of control openings which are located relative to the axis of the one gear at a radial distance corresponding to that of the recesses. The control edges of the recesses of the one gear cooperate with the control openings of the housing and are operative for communicating the control openings with the chambers of the displacement unit.

11 Claims, 3 Drawing Figures

GEROTOR MACHINE WITH FLOW CONTROL RECESSES IN THE INNER GEAR MEMBER

BACKGROUND OF THE INVENTION

The present invention relates to a rotary piston machine. More particularly, it relates to a rotary piston machine which has a centrally guided inner gear wheel, and an outer gear wheel whose axis moves circularly about an axis of rotation of the inner gear wheel.

Rotary piston machines of the above-mentioned general type are known in the art. Such machines are disclosed, for example, in the German Offenlegungsschrift No. 1,703,406 and in the German Pat. Nos. 1,528,998 and 1,528,997. These machines, however, are provided with control systems of the conventional rotary piston machines. This means that a displacement unit which is composed of the inner gear wheel and the outer gear wheel, is separated by stationary or movable control plates of a hydraulic distributor. It is, however, possible to drop the control plate and to perform its functions directly by the displacement unit so as to economize the control plate. One approach to solving this problem is disclosed in the German Offenlegungsschrift No. 2,240,632. The construction disclosed in this patent has a planetarily movable rotor which makes impossible the maintaining of an adequate cross-section for passing of a sufficient quantity of working medium so as to obtain a sufficient number of revolutions of the machine. Moreover, additional auxiliary plates and cover plates for controlling the fluid and complicated control openings in the rotor and the plates are required in this construction.

SUMMARY OF THE INVENTION

Accordingly, it is an object of the present invention to provide a rotary piston machine which avoids the disadvantages of the prior art.

More particularly, it is an object of the present invention to provide a rotary piston machine whose control system is simple and thereby reliable in operation.

In keeping with these objects and with others which will become apparent hereinafter, one feature of the present invention resides, briefly stated, in a rotary piston machine whose displacement unit includes an inner gear member rotatable about an axis and an outer gear member having a further axis which is circularly movable about the axis of the inner gear member and bounding together with the inner gear member a plurality of displacement chambers, wherein means for controlling a flow of pressure medium includes a plurality of recesses provided in one of the gear members and each having two circumferentially spaced edges at one axial side, and a plurality of control openings in a housing and located at the same radial distance at which the recesses are located, which control openings cooperate with the recesses and are operatively communicated by the latter with the displacement chambers.

When the rotary piston machine is constructed in accordance with the present invention, its control system is simple and reliable in operation. The displacement unit simultaneously forms an operationally important part of the control system, whereby the rotary piston machine has a very simple and compact construction which is suitable for high output.

In accordance with another feature of the present invention the control openings may be provided in one part of the housing which part is formed as a flat plate loaded toward the displacement unit. A piston member may be provided which is displaceable in the housing and operative for applying a dosed contact pressure to the plate member.

Still another feature of the present invention is that the recesses of the one gear member may extend only to a central plane of the latter, the central plane extending transverse to the axis of the one gear. The recesses may be formed as slots provided in the inner gear member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
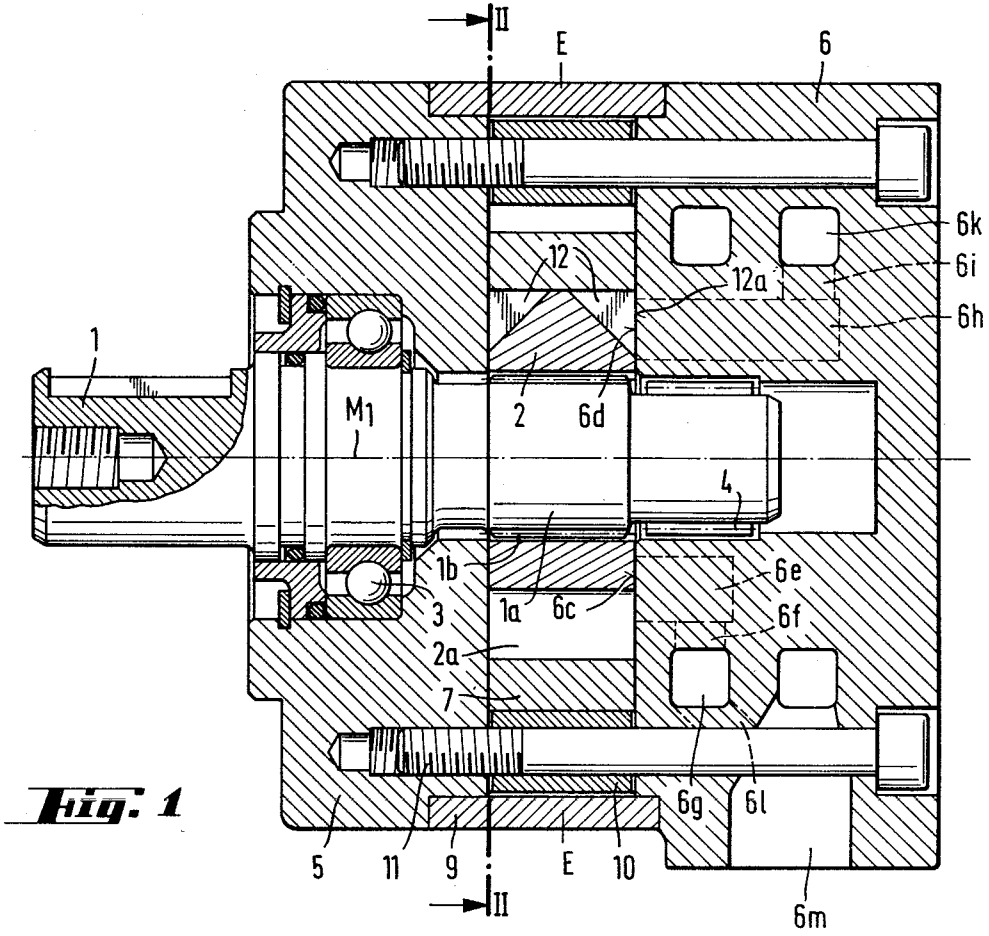
FIG. 1 is a view showing an axial section of a rotary piston machine in accordance with the present invention.
Figure 2:
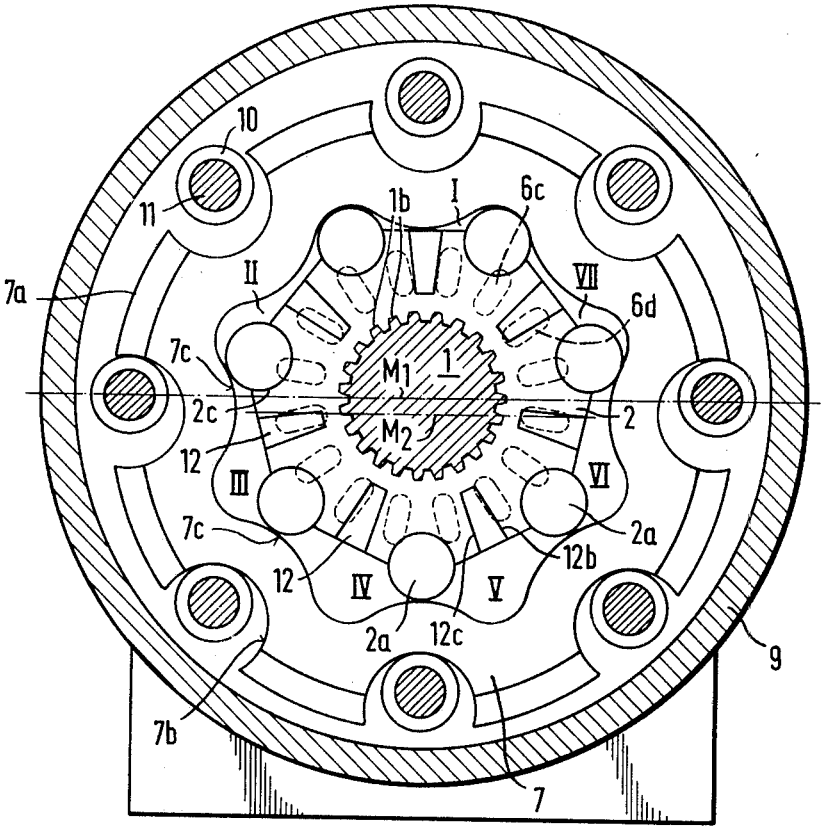
FIG. 2 is a section taken along the line II—II of FIG. 1.

A rotary piston machine in accordance with the present invention has a rotary shaft which is identified by reference numeral 1 and has a central region 1*a* provided with a plurality of grooves 1*b*. An inner gear wheel 2 which formes a rotor of the machine, is formlockingly connected with the rotary shaft 1 with the aid of the grooves 1*b*. The rotary shaft 1 is supported at its both sides in housing parts 5 and 6 by means of roller bearings 3 and 4.

An outer gear wheel 7 forms a stator of the machine and outwardly surrounds the inner gear wheel 2. The inner gear wheel 2 and the outer gear wheel 7 together form a displacement unit of the machine. Teeth 2*a* of the inner gear wheel 2 formed by rollers, are in continuous contact with the outer gear wheel 7 and bounds with the latter displacement chambers I–VII. The rollers are rotatably arranged in the respective recesses 2*c* of the inner gear wheel. The outer gear wheel 7 has, at its outer periphery 7*a*, a plurality of recesses 7*b* formed as circular segments. The supporting rollers 10 cooperate with the recesses 7*b*, and thereby the outer gear wheel is reliably supported during its movement.

The outer gear wheel 7 moves along a circular path about a central axis of rotation M1 of the inner gear wheel. More particularly, an axis M2 of the outer gear wheel 7 moves circularly about the axis of rotation M1 of the inner gear wheel 2. The supporting rollers guarantee this movement and are rotatably mounted on connecting screws 11 which connect the housing parts 5 and 6 of FIG. 1 or 5, 6*a*, 6*b* of FIG. 3 through an outer ring 9.

The inner gear wheel 2 has, in the regions 2*d* between the teeth 2*a* formed by the rollers, a plurality of recesses 12. Laterally limiting edges 12*a* of the recesses 12 serve as control edges 12*b* and 12*c*. A plurality of control openings 6*c* and 6*d* (FIG. 1) or 6*ac* and 6*ad* (FIG. 3) are provided in the housing. The control edges 12*b* and 12*c* cooperate with the above-mentioned control openings and are operative for communicating the latter with the respective displacement chambers I–VII. The recesses 12 are formed as slots and extend at most to a central transverse plane E of the inner gear wheel 2. The slot-like construction of the recesses 12 ensures a simple manufacture of the inner gear wheel 2. Moreover, in such a construction the largest possible control cross-section for supplying or withdrawing the pressure medium is provided. Since the recesses 12 extend only to the central transverse plane E of the inner gear wheel 2, they only insignificantly affect the strength of the latter.

The recesses 12 which are located at the side of the housing part 5 do not perform the controlling functions, since in the illustrated construction the housing part 5 are not provided with control openings. Such a construction serves only for a dynamic equalization of the inner gear wheel 2 and for simplification of mounting, inasmuch as the symmetrically constructed inner gear wheel 2 can be mounted in an arbitrary manner. More particularly, after wear of the active control edges of the recesses, the inner gear wheel 2 can be turned around, so that the control edges of the previously passive recesses will now perform the functions of communicating the control openings of the housing part 6 with the chambers I–VII of the displacement unit.

The control openings **6*c* (FIG. 1) communicate with an annular passage 6*g* through passages 6*e* and 6*f*, whereas the control openings 6*d* communicate with an annular passage 6*k* through passages 6*h* and 6*i*. These passages are formed in the housing part 6. The annular passage 6*g* communicates, in turn, with a connecting passage 6*l*, and the annular passage 6*k* communicates with a connecting passage 6*m*. In dependence upon which of the connecting passages is connected with a source of the pressure medium, and which is connected with a reservoir or consumer, the rotor 2 and thereby the rotary shaft 1** of the machine rotates in one or another direction of rotation. Thereby, the rotary piston machine operates as a hydraulic motor. When the rotary shaft is driven from outside, the rotary piston machine operates as a pump, and in dependence upon direction of rotation of the rotor, one or the other connecting passages forms a connecting line to the source of pressure medium or to the reservoir.

Figure 3:
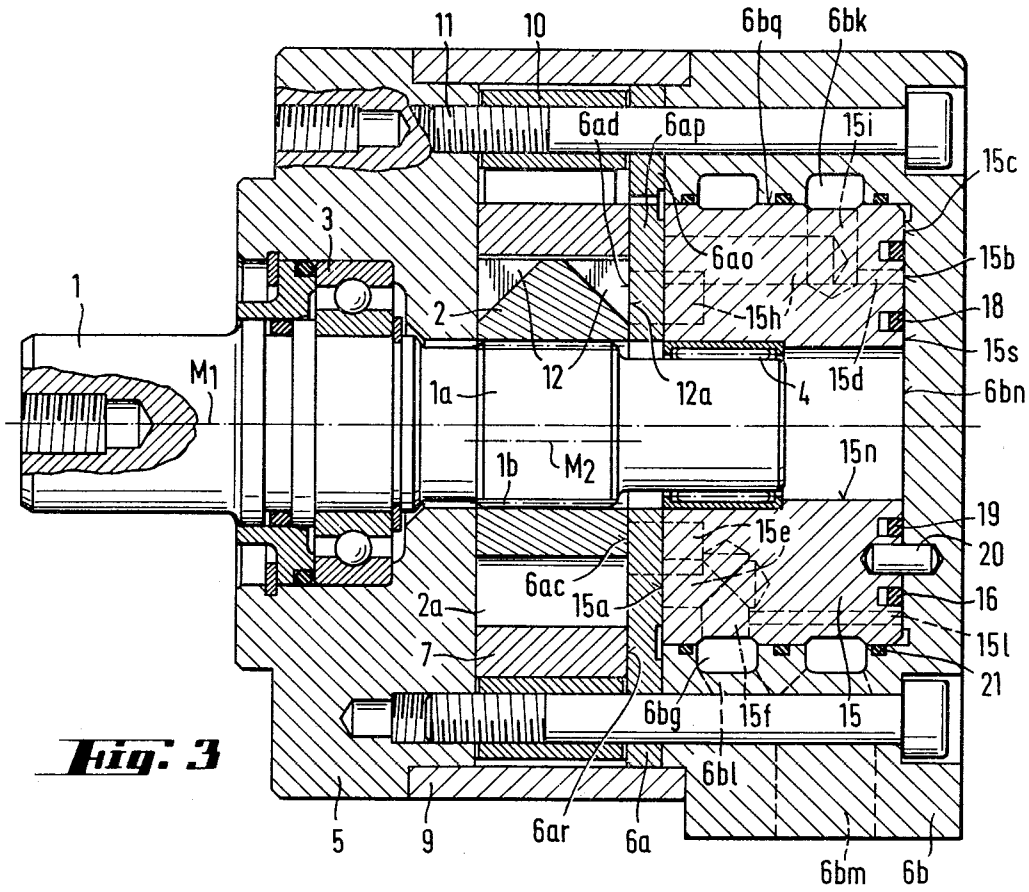
FIG. 3 is a view showing an axial section of a rotary piston machine in accordance with a further embodiment of the invention.

In the rotary piston machine in accordance with the embodiment shown in FIG. 3, control openings **6*ac* and 6*ad* are provided in a housing part 6*a* which is formed as a flat plate. The flat plate 6*a* has an outer region 6*ao* which abuts against a housing part 6*b*, and an inner region 6*ap* which abuts against an end face 15*a* of a piston 15. The piston 15 is located in a reservoir hole 6*bg* of the housing part 6*b*. The piston has two annular pressure faces 15*b* and 15*c* which are separated from one another by a sealing ring 16. The pressure face 15*b* communicated with one of radial passages 15*i* through a passage 15*d*, whereas the pressure face 15*c* communicates with one of radial passages 15*f* through a passage 15*l*. The radial passages 15*i* are open into an annular passage 6*bk*, and the radial passages 15*f* are open into an annular passage 6*bg*. The annular passage 6*bk* communicates in turn with a connecting passage 6*bm*, and the annular passage 6*bg* communicates with a connecting passage 6*bl*. The radial passages 15*i* communicates further with axial control passages 15*h* and with the respective control openings 6*ad*, whereas the radial passages 15*f* communicate through passages 15*e* with the respective control openings 6*ac* of the housing part 6*a***.

In dependence upon the direction of rotation of the rotor 2, whether the pressure face **15*b* or the pressure face 15*c* of the piston 15 is subjected to the action of pressure medium through the connecting passages 15*h*, 15*e*. Thereby, a respectively great pressing force is applied by the piston 15 to the housing plate 6*a* in direction of the displacement unit. This force ensures that in condition of increasing pressure, a gap between end face 6*ar* of the housing plate 6*a* and the displacement unit is maintained by the housing plate 6*a***, due to its elasticity constant or is even reduced. As a result of this, the inventive rotary piston machine has a reduced leakage, whereby it is especially suitable for high pressure operation.

An end face **15*s* of the piston 15 has an annular groove 19 in which a sealing ring 18 is accommodated. The sealing ring 18 prevents escape of the pressure medium in the region of the pressure face 15*b* into the region of a receiving hole 15*n* of the roller bearing 4. A further sealing ring 21 is accommodated in an annular groove in the region of the blind hole 6*bq*, the sealing ring serving to prevent escape of the pressure medium in the region of the pressure face 15*c* in the direction of the annular passage 6*bk*. An adjusting pin 20 between a bottom 6*bn* of the housing part 6*b* and the end face 15*s* of the piston 15 prevents rotation of the piston relative to the housing part 6*b*, so that the passages 15*e* and 15*h* are maintained in alignment with the control openings 6*ac* and 6*ad*** of the housing plate.

The control openings **6*c*, 6*d* or 6*ac*, 6*ad* are uniformly distributed in the housing part 6 or 6*a*, respectively, about the axis M1. Each control opening subjected to a negative pressure, is located adjacent to a control opening subjected to a positive pressure. At the same time, each pair of the control openings 6*c* and 6*d*, including one control opening subjected to the negative pressure and the other control opening subjected to the positive pressure, is located between two teeth 7*c* of the outer gear ring 7. Thereby, a circular pressure field acts upon the rotor, and reversal of the respective displacement chamber from negative pressure to positive pressure and vice versa is performed when the respective displacement chamber attains its maximum or minimum volume. Since the inner gear wheel 2 has a number of teeth which is by one fewer than the number of teeth of the outer gear wheel 7**, the maximum and minimum volumes cannot be attained simultaneously in two displacement chambers. Thereby a substantially uniform rotary movement of the rotor is guaranteed, during operation of the inventive rotary piston machine as a hydraulic motor. Similarly, a substantially uniform flow of the pressure fluid is guaranteed, during operation of the inventive rotary piston machine as a pump.

It will be understood that each of the elements described above, or two or more together, may also find a useful application in other types of constructions differing from the types described above.

While the invention has been illustrated and describes as embodied in a rotary piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed as new and desired to be protected by Letters Patent is set forth in the appended claims.

1. A gerotor machine, comprising a housing; a displacement unit in said housing and including an inner gear member having an axis of rotation, and an outer gear member having a further axis circularly movable about said axis of rotation of said inner gear member without rotating of said outer gear member about said further axis, said inner gear member having a plurality of teeth with teeth root sections and intermediate sections located between said teeth root sections, said gear members bounding a plurality of displacement chambers therebetween; and means for controlling a flow of pressure medium and including a plurality of radial groove-shaped recesses formed in said inner gear member at one axial side of the latter and each arranged in a respective one of said intermediate sections without extending into said teeth root sections, each of said radial groove-shaped recesses being bounded by two circumferentially spaced control edges, said flow controlling means further including a plurality of control openings formed in said housing and arranged relative to the axis of said inner gear member at a radial distance corresponding to that of said recesses, said control edges of said recesses cooperating with said control openings and being operative for controlling the communication of the latter with said displacement chambers.

2. A gerotor machine as defined in claim 1, wherein said inner gear member is located centrally in said housing.

3. A gerotor machine as defined in claim 1, wherein said inner gear member has a central plane extending in a direction transverse to the axis of the same, said recesses extending at most to said central plane of said inner gear member.

4. A gerotor machine as defined in claim 1, wherein said plurality of control openings includes a first group of openings operative for supplying the pressure medium to said displacement unit, and a second group of openings operative for withdrawing the pressure medium from the latter.

5. A gerotor machine as defined in claim 1, wherein said housing is composed of two housing parts, said displacement unit being located between said housing parts.

6. A gerotor machine as defined in claim 5, wherein said control openings are formed only in one of said housing parts.

7. A gerotor machine as defined in claim 6, wherein said one housing part includes a flat plate member which bounds said displacement unit at its one axial side and is loaded in a direction toward said displacement unit.

8. A gerotor machine as defined in claim 7; and further comprising a piston actuated by the pressure medium and operative for loading said plate member in the direction toward said displacement unit.

9. A gerotor machine as defined in claim 8, wherein said one housing part includes a further member, said piston being axially movable in said further member and having an end face abutting against said plate member.

10. A gerotor machine as defined in claim 9, wherein said piston has control passages which are open at said end face and cooperate with said control openings provided in said plate member.

11. A gerotor machine as defined in claim 9, wherein said piston has a side facing away from said displacement unit and further end faces which are formed at said side and operative for applying a dosed contact pressure by said piston to said plate member provided with said control openings.

* * * * *

Notice of Adverse Decision in Interference

In Interference No. 101,236, involving Patent No. 4,264,288, P. Wusthof, and J. Schneider, GEROTOR MACHINE WITH FLOW CONTROL RECESSES IN THE INNER GEAR MEMBER, final judgment adverse to the patentees was rendered Oct. 30, 1984, as to claims 1–7.

[*Official Gazette January 29, 1985.*]